US006253931B1

(12) United States Patent
Starkey

(10) Patent No.: US 6,253,931 B1
(45) Date of Patent: Jul. 3, 2001

(54) ORAL HYGIENE PRODUCT STORAGE SYSTEM

(76) Inventor: Benita D. Starkey, 18971 Wisconsin, Detroit, MI (US) 48221

( * ) Notice: Subject to any disclaimer, the term of this patent is extended or adjusted under 35 U.S.C. 154(b) by 0 days.

(21) Appl. No.: 09/599,062

(22) Filed: Jun. 21, 2000

(51) Int. Cl.[7] ..... A47B 81/02

(52) U.S. Cl. ..... 211/65; 211/87.01; D6/528; D6/530; D6/531

(58) Field of Search ..... 211/65, 66, 87.01; 312/245, 207; D6/528, 529, 530, 531, 534, 535, 541

(56) References Cited

U.S. PATENT DOCUMENTS

| | | | | |
|---|---|---|---|---|
| D. 78,498 | * | 5/1929 | Balmer . | |
| D. 241,200 | * | 8/1976 | Halsted et al. . | |
| 1,581,250 | * | 4/1926 | Treubig . | |
| 1,975,691 | * | 10/1934 | Hibbs . | |
| 2,400,445 | * | 5/1946 | Tucker . | |
| 2,956,851 | | 10/1960 | Merendino | 312/207 |
| 3,173,578 | * | 3/1965 | Williams . | |
| 3,204,823 | * | 9/1965 | Watson . | |
| 3,409,144 | | 11/1968 | Bridgman | 211/65 |
| 4,219,035 | | 8/1980 | Deconinck | 132/84 |
| 5,566,842 | | 10/1996 | Dennis | 211/87 |
| 5,769,245 | | 6/1998 | Butler | 211/65 |
| 5,799,910 | | 9/1998 | Dexter | 248/109 |

* cited by examiner

*Primary Examiner*—Robert W. Gibson, Jr.
(74) *Attorney, Agent, or Firm*—Joseph N. Breaux

(57) ABSTRACT

An oral hygiene product storage system that includes a product holding structure, a transparent holding structure cover and a toothpaste tube roller member.

1 Claim, 2 Drawing Sheets

ORAL HYGIENE PRODUCT STORAGE SYSTEM

TECHNICAL FIELD

The present invention relates to oral hygiene products and more particularly to an oral hygiene product storage system that includes a product holding structure, a transparent holding structure cover and a toothpaste tube roller member; the product holding structure including a product support member integrally formed with and perpendicularly oriented to a wall attachment plate having mounting holes proved therethrough; the product support member having an octagonally shaped cup holder portion including an octagonal shaped depression formed into the product support member having a bottom thereof blocked by a cup support framework having eight supports extending radially from a circular center member at one end and integrally formed with the product support member at the other end, six oblong shaped toothbrush holder apertures formed through the product support member positioned such that the octagonally shaped cup holder portion has three toothbrush holder apertures on one side thereof and three toothbrush holder apertures on an opposite side thereof, a toothpaste holder aperture formed therethrough adjacent to three of the toothbrush holder apertures and having two opposed triangular end section connected by a rectangular center section, and a cover receiving ledge provided around the upper perimeter edge for frictionally receiving the bottom edge of the transparent cover; the toothpaste tube roller member having a cylinder shaped tube engaging portion provided with a tube end receiving aperture formed therethrough and a turning knob end having gripping ridges formed therein.

BACKGROUND ART

Oral hygiene products such as toothbrushes, toothpaste tubes and rinsing glasses can become contaminated with germs and chemicals if not properly stored in a protected environment. It would be a benefit, therefore, to have an oral hygiene product storage system that includes a product holding structure, a transparent holding structure cover and a toothpaste tube roller member.

GENERAL SUMMARY DISCUSSION OF INVENTION

It is thus an object of the invention to provide an oral hygiene product storage system that includes a product holding structure, a transparent holding structure cover and a toothpaste tube roller member; the product holding structure including a product support member integrally formed with and perpendicularly oriented to a wall attachment plate having mounting holes proved therethrough; the product support member having an octagonally shaped cup holder portion including an octagonal shaped depression formed into the product support member having a bottom thereof blocked by a cup support framework having eight supports extending radially from a circular center member at one end and integrally formed with the product support member at the other end, six oblong shaped toothbrush holder apertures formed through the product support member positioned such that the octagonally shaped cup holder portion has three toothbrush holder apertures on one side thereof and three toothbrush holder apertures on an opposite side thereof, a toothpaste holder aperture formed therethrough adjacent to three of the toothbrush holder apertures and having two opposed triangular end section connected by a rectangular center section, and a cover receiving ledge provided around the upper perimeter edge for frictionally receiving the bottom edge of the transparent cover; the toothpaste tube roller member having a cylinder shaped tube engaging portion provided with a tube end receiving aperture formed therethrough and a turning knob end having gripping ridges formed therein.

Accordingly, an oral hygiene product storage system is provided. The oral hygiene product storage system includes a product holding structure, a transparent holding structure cover and a toothpaste tube roller member; the product holding structure including a product support member integrally formed with and perpendicularly oriented to a wall attachment plate having mounting holes proved therethrough; the product support member having an octagonally shaped cup holder portion including an octagonal shaped depression formed into the product support member having a bottom thereof blocked by a cup support framework having eight supports extending radially from a circular center member at one end and integrally formed with the product support member at the other end, six oblong shaped toothbrush holder apertures formed through the product support member positioned such that the octagonally shaped cup holder portion has three toothbrush holder apertures on one side thereof and three toothbrush holder apertures on an opposite side thereof, a toothpaste holder aperture formed therethrough adjacent to three of the toothbrush holder apertures and having two opposed triangular end section connected by a rectangular center section, and a cover receiving ledge provided around the upper perimeter edge for frictionally receiving the bottom edge of the transparent cover; the toothpaste tube roller member having a cylinder shaped tube engaging portion provided with a tube end receiving aperture formed therethrough and a turning knob end having gripping ridges formed therein.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
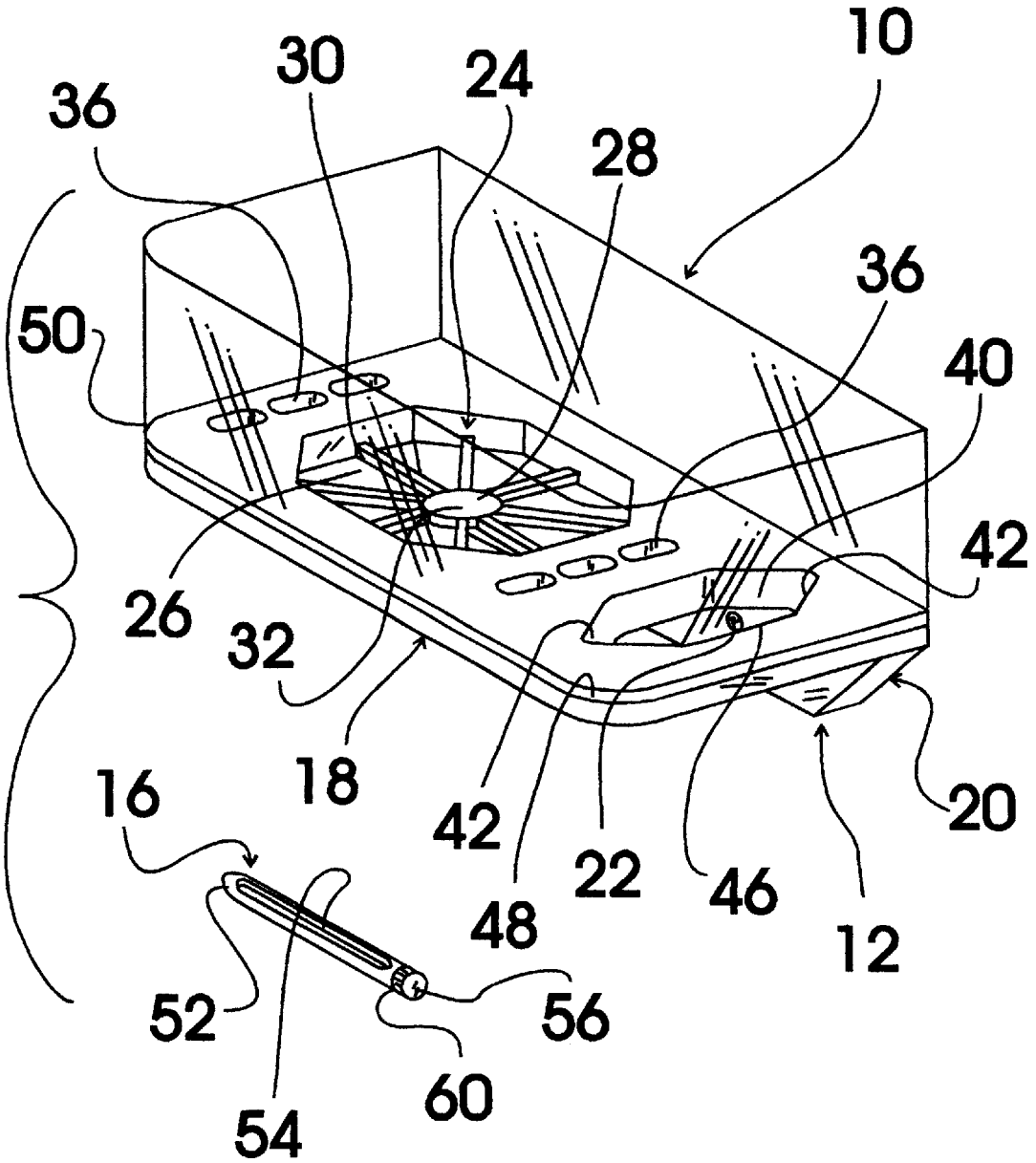
FIG. 1 is a perspective view of the exemplary oral hygiene product storage system of the present invention showing the product holding structure, the transparent holding structure cover and the toothpaste tube roller member; the product holding structure including a product support member integrally formed with and perpendicularly oriented to a wall attachment plate having mounting holes proved therethrough; the product support member having an octagonally shaped cup holder portion including an octagonal shaped depression formed into the product support member having a bottom thereof blocked by a cup support framework having eight supports extending radially from a circular center member at one end and integrally formed with the product support member at the other end, six oblong shaped toothbrush holder apertures formed through the product support member positioned such that the octagonally shaped cup holder portion has three toothbrush holder apertures on one side thereof and three toothbrush holder apertures on an opposite side thereof, a toothpaste holder aperture formed therethrough adjacent to three of the toothbrush holder apertures and having two opposed triangular end section connected by a rectangular center section, and a cover receiving ledge provided around the upper perimeter edge for frictionally receiving the bottom edge of the transparent cover; the toothpaste tube roller member having a cylinder shaped tube engaging portion provided with a tube end receiving aperture formed therethrough and a turning knob end having gripping ridges formed therein.
Figure 2:
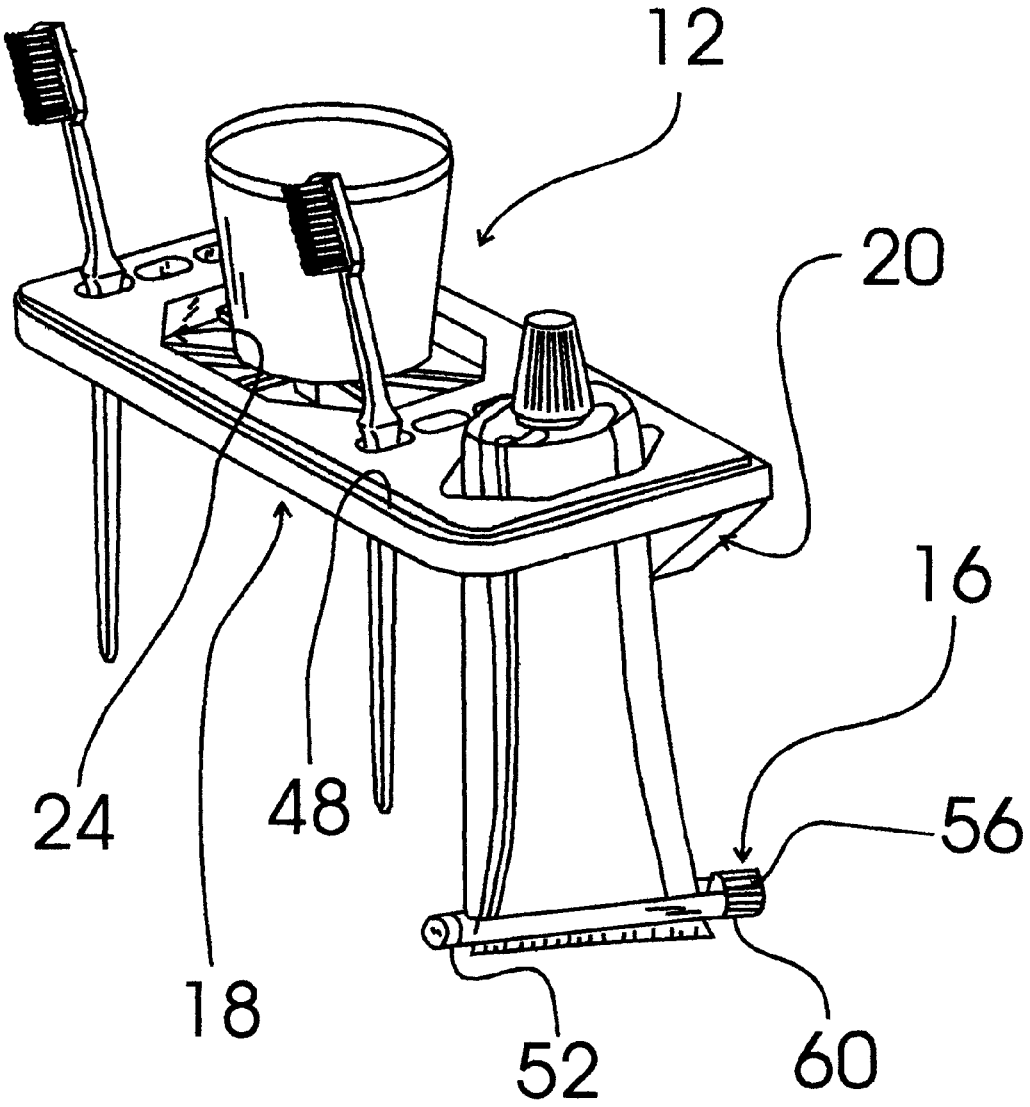
FIG. 2 is a perspective view showing representative tooth brushes, a rinsing cup and a toothpaste tube positioned for storage in connection with the product holding structure and the toothpaste tube roller member.

FIGS. 1 and 2 show various aspects of an exemplary embodiment of the oral hygiene product storage system of the present invention generally designated 10. Oral hygiene product storage system 10 includes a product holding structure, generally designated 12; a transparent holding structure cover, generally designated 14; and a toothpaste tube roller member, generally designated 16.

Product holding structure 12 is molded form opaque plastic and includes a product support member, generally designated 18, integrally formed with and perpendicularly oriented to a wall attachment plate, generally designated 20, having a number of mounting holes 22 proved therethrough. Product support member 18 has an octagonally shaped cup holder portion, generally designated 24, including an octagonal shaped depression 26 formed into product support member 18 having a bottom thereof covered by a cup support framework 28 having eight supports 30 extending radially from a circular center member 30 at one end and integrally formed with product support member 18 at the other end; six oblong shaped toothbrush holder apertures 36 formed through product support member 18 positioned such that octagonally shaped cup holder portion 24 has three toothbrush holder apertures 36 on one side thereof and three toothbrush holder apertures 36 on an opposite side thereof; a toothpaste holder aperture 40 formed therethrough adjacent to three of the toothbrush holder apertures 36 and having two opposed triangular end sections 42 connected by a rectangular center section 46; and a cover receiving ledge 48 provided around the upper perimeter edge for frictionally receiving a bottom edge 50 of transparent cover 12.

Toothpaste tube roller member 16 is molded from plastic and has a cylinder shaped tube engaging portion 52 provided with a tube end receiving aperture 54 formed therethrough and a turning knob end 56 having gripping ridges 60 formed therein.

It can be seen from the preceding description that an oral hygiene product storage system has been provided.

It is noted that the embodiment of the oral hygiene product storage system described herein in detail for exemplary purposes is of course subject to many different variations in structure, design, application and methodology. Because many varying and different embodiments may be made within the scope of the inventive concept(s) herein taught, and because many modifications may be made in the embodiment therein detailed in accordance with the descriptive requirements of the law, it is to be understood that the details herein are to be interpreted as illustrative and not in a limiting sense.

What is claimed is:

1. An oral hygiene product storage system comprising:

a product holding structure;

a transparent holding structure cover; and a toothpaste tube roller member;

said product holding structure including a product support member integrally formed with and perpendicularly oriented to a wall attachment plate having mounting holes proved therethrough;

said product support member having an octagonally shaped cup holder portion including an octagonal shaped depression formed into said product support member having a bottom thereof blocked by a cup support framework having eight supports extending radially from a circular center member at one end and integrally formed with said product support member at said other end, six oblong shaped toothbrush holder apertures formed through said product support member positioned such that said octagonally shaped cup holder portion has three toothbrush holder apertures on one side thereof and three toothbrush holder apertures on an opposite side thereof, a toothpaste holder aperture formed therethrough adjacent to three of said toothbrush holder apertures and having two opposed triangular end section connected by a rectangular center section, and a cover receiving ledge provided around said upper perimeter edge for frictionally receiving said bottom edge of said transparent cover;

said toothpaste tube roller member having a cylinder shaped tube engaging portion provided with a tube end receiving aperture formed therethrough and a turning knob end in connection with an end of said tube engaging portion having gripping ridges formed therein.

* * * * *